US005836378A

United States Patent [19]

Brophy et al.

[11] Patent Number: 5,836,378

[45] Date of Patent: Nov. 17, 1998

[54] AIR PREHEATER ADJUSTABLE BASKET SEALING SYSTEM

[75] Inventors: Mark E. Brophy, Wellsville, N.Y.; Harlan E Finnemore, Pocatello, Id.

[73] Assignee: ABB Air Preheater, Inc., Wellsville, N.Y.

[21] Appl. No.: 665,077

[22] Filed: Jun. 14, 1996

[51] Int. Cl.[6] ..... F23L 15/02

[52] U.S. Cl. ..... 165/9; 165/10; 165/8

[58] Field of Search ..... 165/9, 10, 8

[56] References Cited

U.S. PATENT DOCUMENTS

| | | | |
|---|---|---|---|
| 2,821,367 | 1/1958 | Muller | 165/9 |
| 3,155,152 | 11/1964 | Condé | 165/9 |
| 3,216,486 | 11/1965 | Hall et al. | 165/9 |
| 3,270,803 | 9/1966 | Hazzard | 165/9 |
| 3,545,532 | 12/1970 | Waitkus | 165/9 X |
| 3,710,850 | 1/1973 | Kurschner et al. | 165/9 |
| 3,710,851 | 1/1973 | Finnemore | 165/9 |
| 3,800,860 | 4/1974 | Johnsson | 165/9 |
| 3,818,978 | 6/1974 | Finnemore | 165/9 |
| 4,044,822 | 8/1977 | Stockman | 165/9 |
| 5,577,551 | 11/1996 | Kritzler et al. | 165/9 |

FOREIGN PATENT DOCUMENTS

| | | | |
|---|---|---|---|
| 1143601 | 2/1963 | Germany | 165/9 |

*Primary Examiner*—Ira S. Lazarus
*Assistant Examiner*—Christopher Atkinson
*Attorney, Agent, or Firm*—Alix, Yale & Ristas, LLP

[57] ABSTRACT

The rotor for a rotary regenerative air preheater is fabricated from upper and lower rotor shell segments and hot-end and cold-end heat exchange baskets having closed outboard ends, the rotor shell segments and heat exchange baskets defining a first gap between the upper rotor shell segment and the hot-end heat exchange basket, a second gap between the hot-end and cold-end or intermediate heat exchange baskets, and a third gap between the cold-end heat exchange baskets and the lower rotor shell segment. A system for sealing the gaps includes first, second and third sealing members, each sealing member having first and second portions. The first sealing member is mounted to the upper rotor shell segment or the hot-end outboard heat exchange basket and engages the other of the upper rotor shell segment or the hot-end outboard heat exchange basket to seal the first gap. The second sealing member is mounted to the hot-end or the cold-end or intermediate heat exchange baskets and engages the other of the hot-end or cold end heat exchange baskets to seal the second gap. The third sealing member is mounted to the cold-end heat exchange basket and engages the other of the lower rotor shell segment to seal the third gap.

19 Claims, 4 Drawing Sheets

AIR PREHEATER ADJUSTABLE BASKET SEALING SYSTEM

BACKGROUND OF THE INVENTION

The present invention relates to rotary regenerative heat exchangers generally used as air preheaters and more particularly to a novel adjustable basket sealing system for the reduction of bypass flow in grating rotors around the outside of the baskets at the periphery of the rotor.

A rotary regenerative air preheater transfers sensible heat from the flue gas leaving a boiler to the entering combustion air through regenerative heat transfer surface in a rotor which turns continuously through the gas and air streams. The rotor is divided into compartments by a number of radially extending plates referred to as diaphragms. These compartments are adapted to hold modular heat exchange baskets which contain the mass of heat absorbent material commonly formed of stacked plate-like elements.

In a typical rotary regenerative heat exchanger, the hot flue gas and the combustion air enter the rotor shell from opposite ends and pass in opposite directions over the heat exchange material housed within the rotor. Consequently, the cold air inlet and the cooled gas outlet are at one end of the heat exchanger, referred to as the cold end, and the hot gas inlet and the heated air outlet are at the opposite end of the heat exchanger, referred to as the hot end.

The air preheater is divided into a flue gas side or sector and one or more combustion air sides or sectors by sector plates. Flexible radial seals on the rotor, usually mounted on the top and bottom edges of the diaphragms, are in close proximity to these sector plates and minimize leakage of gas and air between sectors to separate the air and flue gas streams from each other. Likewise, a rotor shell is mounted to the outboard ends of the diaphragms, forming the periphery of the rotor, to prevent the air and gas streams from flowing through the peripheral ends of the sectors and bypassing the heat-transfer surface. Circumferential seals seal the gap between the rotor and the rotor housing to prevent bypass flow through the annulus formed between the rotor and the rotor housing.

However, rotor shells typically have several deficiencies. The rotor shell has a height that is greater than the combined height of all heat absorbent elements in the baskets. Therefore, the rotor shell provides more structure than is required to prevent bypass flow around these baskets. This excess structure results in increased manufacturing costs and increased rotor weight. Openings are provided in the rotor shell to allow loading of the cold-end baskets. These openings are closed by cold-end covers which are mounted to the rotor shell by studding. Typically, neither the rotor shell nor the cold-end covers contact the basket elements, creating a bypass gap between the outboard baskets and the shell. Consequently, the rotor shell does not eliminate all bypass flow.

SUMMARY OF THE INVENTION

The present invention provides an arrangement of means in an air preheater for sealing gaps around the baskets at the periphery of the rotor, thereby eliminating flow paths that would allow portions of the air and gas stream to bypass the heat transfer surface. More particularly, the present invention provides a circumferential sealing system for sealing gaps between the heat exchange baskets and the rotor shell portions. The present invention also provides means in an air preheater to minimize the size of the peripheral seal structure, effectively reducing the weight of the rotor. The present invention further eliminates the cold-end covers and attachment studding, thereby reducing the cost of manufacture.

DESCRIPTION OF THE PREFERRED EMBODIMENTS

Figure 1:
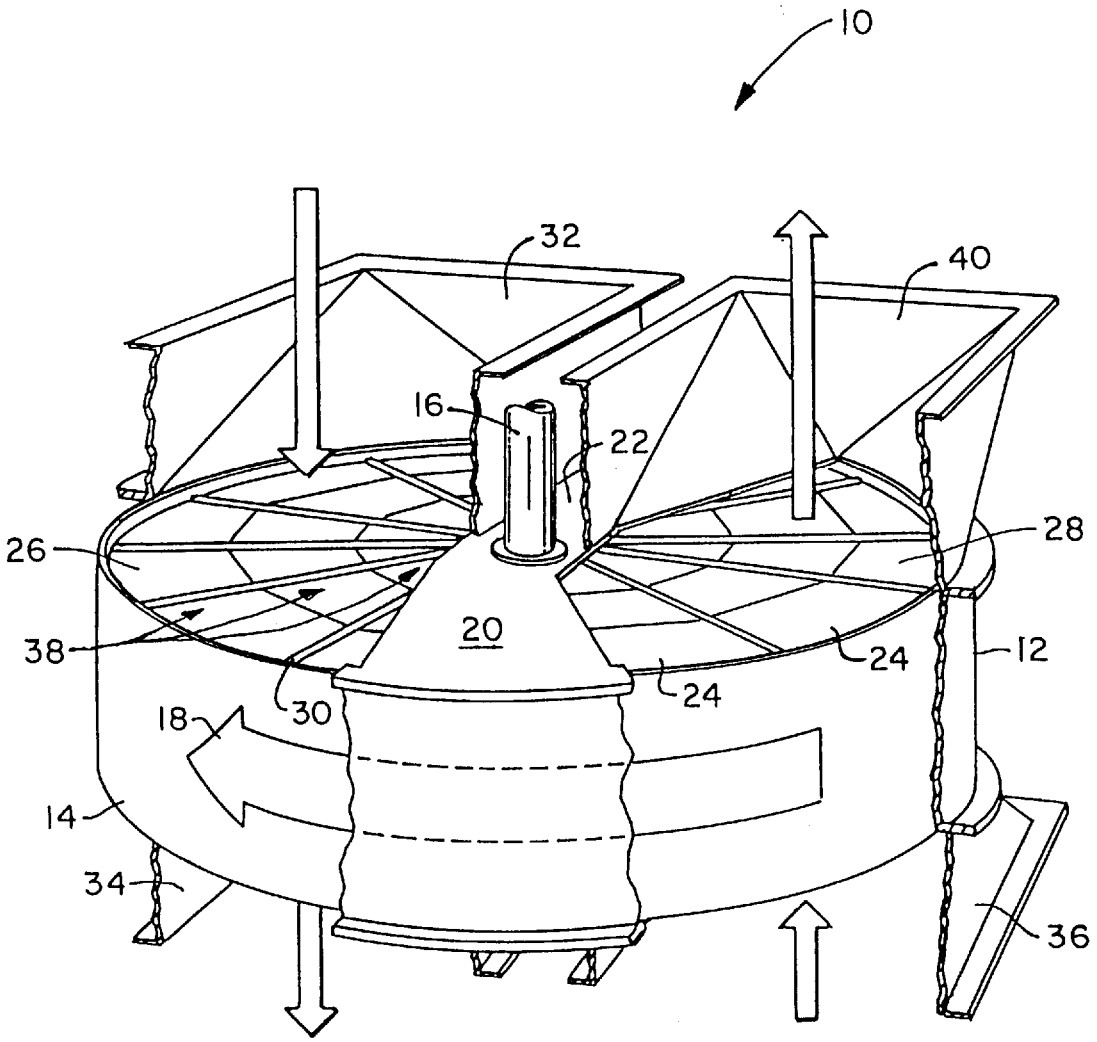
FIG. 1 PRIOR ART
FIG. 1 is a general perspective view of a conventional rotary regenerative air preheater.

FIG. 1 of the drawings is a partially cut-away perspective view of a typical bi-sector air preheater 10 showing a housing 12 in which the rotor 14 is mounted on a drive shaft or post 16 for rotation as indicated by the arrow 18. The housing is divided by means of the flow impervious sector plates 20, 22 into a flue gas side 26 and an air side 28. Corresponding sector plates are also located on the bottom of the unit. The hot flue gases enter the air preheater 10 through the gas inlet duct 32, flows through a sector 24 in the flue gas side 26 where heat is transferred to the heat transfer surface in the rotor 14 and then exits through gas outlet duct 34. As this hot heat transfer surface then rotates through the air sector 28 the heat is transferred to the air flowing through the rotor from the air inlet duct connector 36. The heated air stream forms a hot air stream and leaves the air preheater 10 through the duct connector section 40. Consequently, the cold air inlet and the cooled gas outlet 34 define a cold end of the heat exchanger and the hot gas inlet 32 and the heated air outlet define a hot end of the heat exchanger. In a trisector air preheater, an additional sector plate divides the air sector into primary and secondary air sectors.

Figure 2:
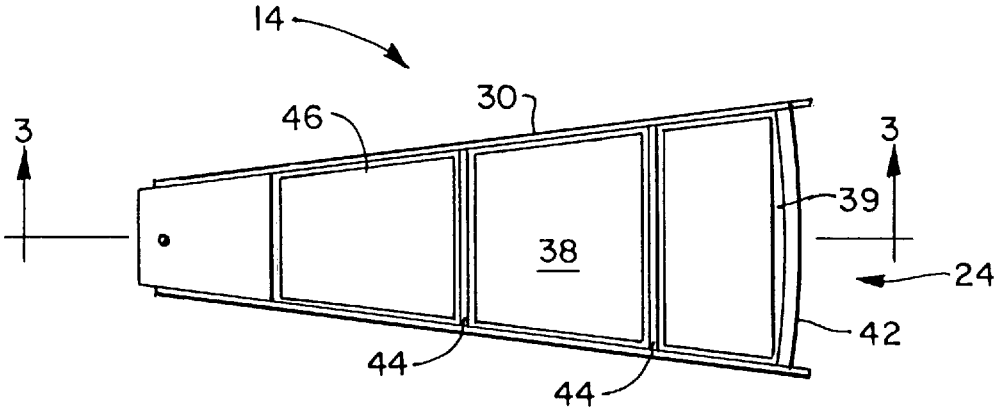
FIG. 2 PRIOR ART
FIG. 2 is a top plan view of a sector of the rotor of FIG. 1.
Figure 3:
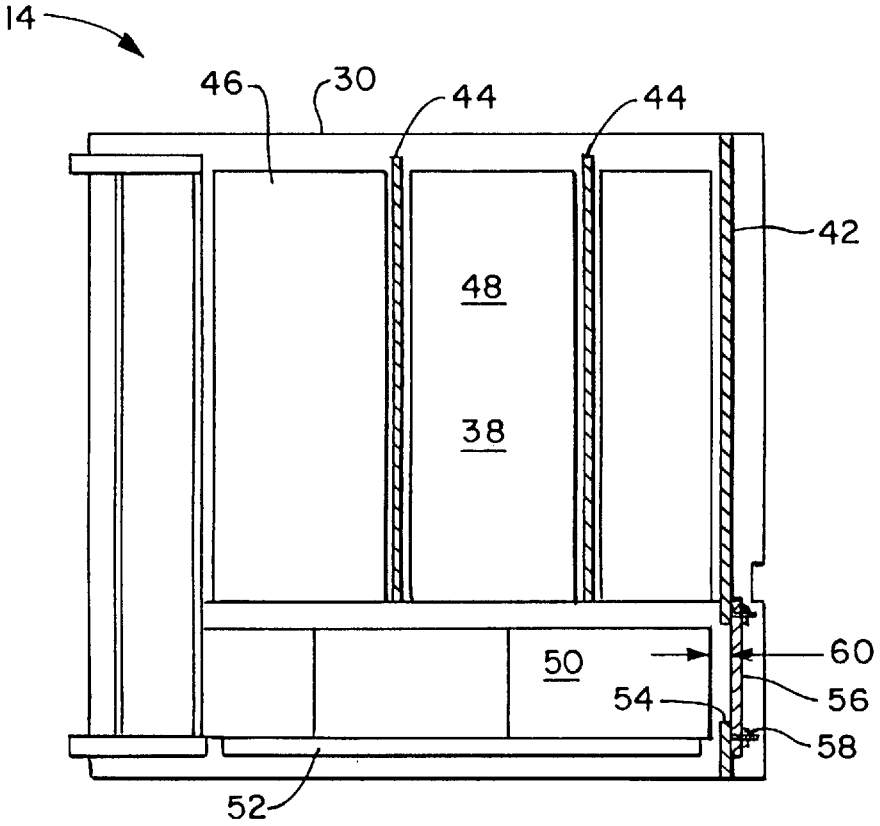
FIG. 3 PRIOR ART
FIG. 3 is a cross-section view taken along line 3—3 of FIG. 2 illustrating heat exchange baskets in position in the rotor.

The rotor 14 is composed of a plurality of sectors 24 with each sector 24 containing a number of basket modules 38 and with each sector being defined by the diaphragms 30. The diaphragms 30 extend radially between the central portion or hub of the rotor and the rotor shell 42. In a typical air preheater, stay plates 44 extend between and are attached to the diaphragms 30 at spaced intervals thereby forming stay plate compartments 46 (FIGS. 2 and 3). The hot-end basket modules 48 are axially loaded into the stay plate compartments 46 and stacked therein. The cold-end basket modules 50 are inserted radially from the periphery of the rotor and are supported on a grating or truss structure 52, allowing easier and more frequent removal. The outboard end 39 of the basket modules 38 is closed to prevent the gas or air from flowing out of the basket modules 38.

A rotor shell 42 is mounted on the periphery of the rotor 14 which serves as a structural member but which also prevents the air and gas streams from flowing out of the peripheral ends of the rotor, thereby bypassing the heat-transfer surface. Also, there is a space between the rotor shell and the baskets through which the gases can bypass the heat transfer surface. Typically such rotor shells 42 have a height that is greater than the combined height of all heat absorbent elements in the baskets 38. Therefore, the size of the rotor shell 42 is greater than that actually required to prevent bypass flow. This excess structure results in increased manufacturing costs and increased rotor weight. Openings 54 are provided in the rotor shell 42 to allow radial loading of the cold-end baskets 50. These openings 54 are closed by cold-end covers 56 which are mounted to the rotor shell by studding 58. Typically, neither the rotor shell 42 or the cold-end covers 56 contact the cold-end basket 50, creating a bypass gap 60. Consequently, the rotor shell 42 and cold-end covers 56 do not eliminate all bypass flow.

Figure 4:
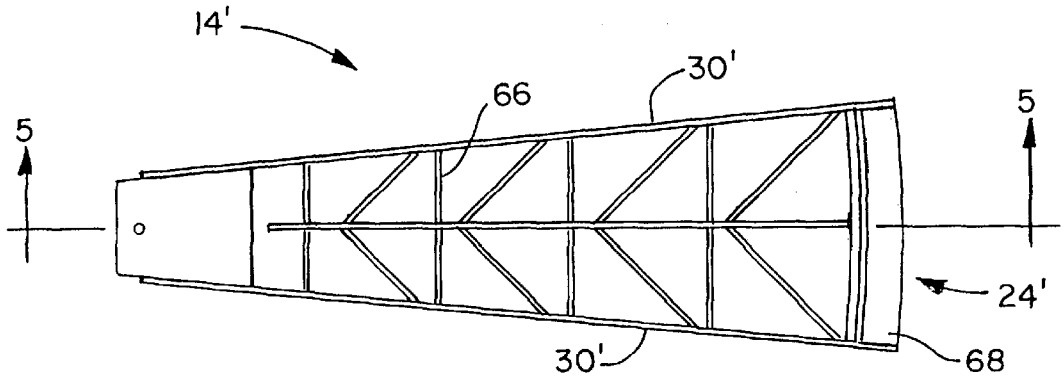
FIG. 4 is an enlarged top plan view of a sector of a rotor in accordance with the present invention.
Figure 5:
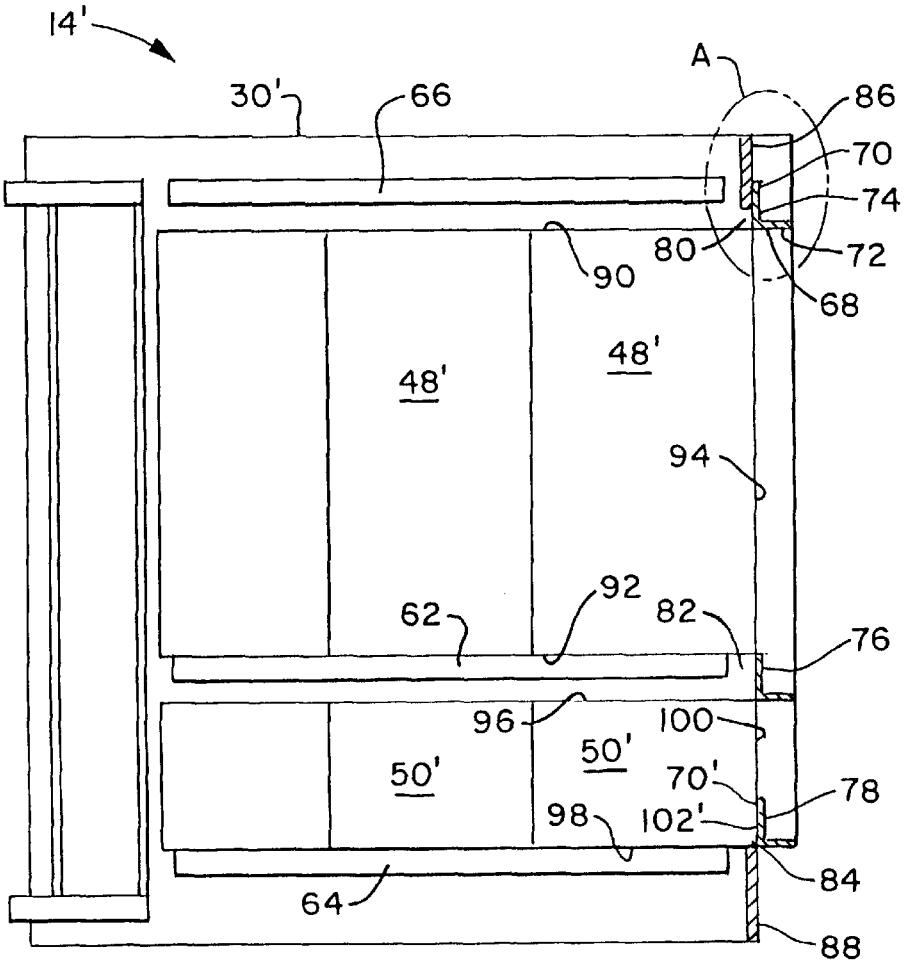
FIG. 5 is a cross-section view taken along line 5—5 of FIG. 4 illustrating heat exchange baskets in position in the rotor.

U.S. patent application Ser. No. 08/604,914, filed Feb. 22, 1996 and assigned to the assignee of the subject application, describes a semi-modular grating rotor for an air preheater and is hereby incorporated by reference. As shown in FIGS. 4 and 5, such a rotor module 14' utilizes support gratings to tie the diaphragms 30' together instead of stay plates. Removal of the stay plates allows both the hot-end and cold-end baskets 48', 50' to be loaded radially into each rotor module 14'. Two levels of grating 62 and 64 are provided to support the hot-end baskets 48' and cold-end baskets 50'. A third level of grating 66 positioned above the hot-end baskets 48' ties the hot end of the diaphragms 30' together to provide additional strength and stability to the rotor structure.

A rotor in accordance with the present invention utilizes a plurality of sealing members 68 to block the bypass flow. Each sealing member 68 has an arcuate-shape when viewed from the top or bottom, as shown in FIG. 4. In the embodiment shown in FIG. 5, each sealing member 68 comprises a first portion 70 and an orthogonally extending second portion 72. A first sealing member 74 is used to block the gap 80 between the upper rotor shell segment 86 and the top surface 90 of the hot-end basket 48', a second sealing member 76 is used to block the gap 82 between the lower surface 92 of the hot-end basket 48' and the upper surface 96 of the cold-end basket 50', and a third sealing member 78 is used to block the gap 84 between the lower surface 98 of the cold-end basket 50' and the lower rotor shell segment 88.

Figure 8:
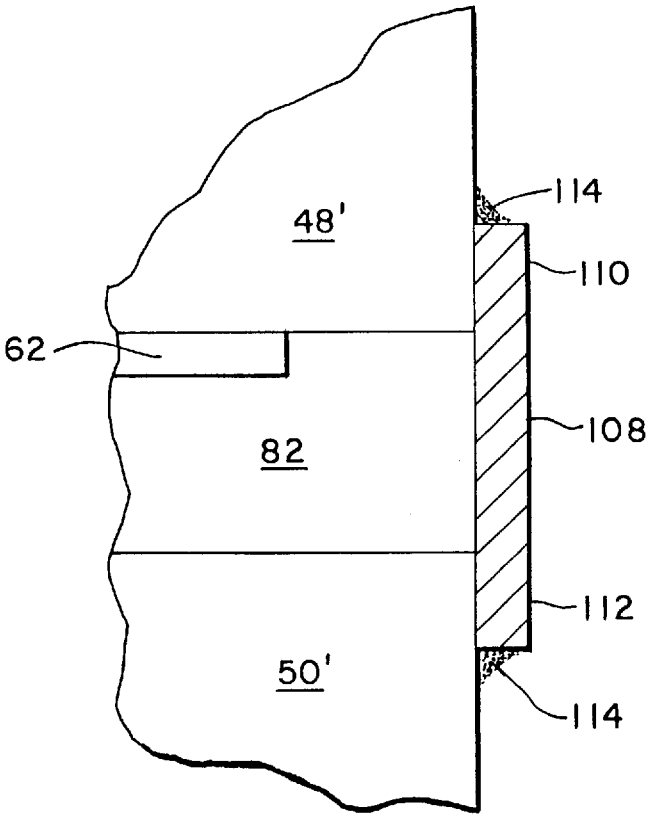
FIG. 8 is an enlarged cross-section view of an alternate embodiment of the hot-end basket, cold-end basket, first grating level and second sealing member of FIG. 5.

Alternatively, each sealing member may comprise a flat plate or bar wherein the first and second portions lie in the same plane. For example, the second sealing member 108 may comprise a flat plate or bar wherein the first and second portions 110, 112 are mounted to the hot-end basket 48' and the cold-end basket 50' by a weld 114, as shown in FIG. 8. It should be appreciated that in alternate embodiments, the second sealing member 108 may be mounted such that either the first portion 110 is mounted to the hot-end basket 48' and the second portion 112 engages the cold-end basket 50' or the second portion 112 is mounted to the cold-end basket 50' and the first portion 110 engages the hot-end basket 48' to seal the gap 82.

Figure 6:
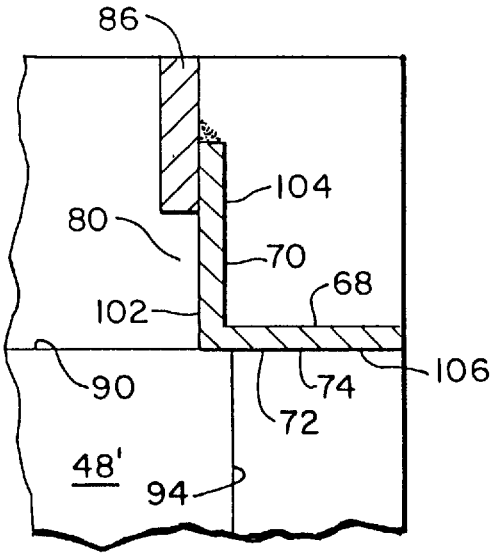
FIG. 6 is an enlarged cross-section view of the rotor structures contained within area A of FIG. 5.
Figure 7:
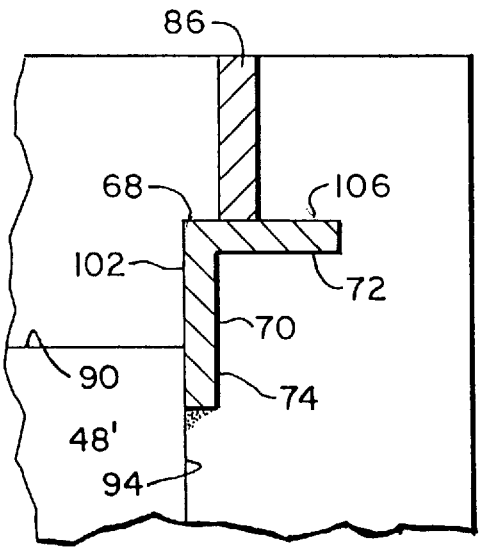
FIG. 7 is a cross-section view of an alternate embodiment of the rotor of FIG. 6.

The L-shaped configuration of the sealing members 68 provides a great degree of flexibility in the application and use of the sealing members 68. For example, the first sealing member 74 shown in FIGS. 5 and 6 has one of its portions 70 mounted to the upper rotor shell segment 86 with the outside surface 102 engaging the surface of the upper rotor shell segment 86. The outside surface 106 of the second portion 72 engages the upper surface 90 of the hot-end basket 48' to close gap 80. Should the upper surface 90 of the hot-end basket 48' be positioned such that it will not engage the outside surface 106 of the second portion 72, the sealing member 68 may be reversed in orientation and the first portion 70 mounted to the outboard surface 94 of the hot-end basket 48' such that the outside surface 106 of the second portion 72 engages the upper rotor shell segment 86 and the outside surface 102 of the first portion 70 engages the outboard surface 94 of the hot-end basket 48' to close gap 80, as shown in FIG. 7.

The sealing members 68 may also be mounted to the basket structures rather than to the rotor structure. For example, the third sealing member 78 shown in FIG. 5 has a first portion 70' mounted to the outboard surface 100 of the cold-end basket 50'. The surface 102' of the first portion 70' that is mounted to the cold-end basket 50' engages the lower rotor shell segment 88 to seal the gap 84 between the cold-end basket 50' and the lower rotor shell segment 88. Similarly, the second sealing member 76 is mounted to the outboard surface 94 of the hot-end basket 48' and engages the outboard surface 100 of the cold-end basket 50' to seal the gap 82 between the hot-end and cold-end baskets 48', 50'. It should be appreciated that the second sealing member 76 may engage the lower surface 92 of the hot-end basket 48', the upper surface 96 of the cold-end basket 50', or the outboard surfaces 94, 100 of both the hot-end basket 48' and the cold-end basket 50 to seal gap 82. It should be further appreciated that the third sealing member 78 may be mounted to the lower rotor shell segment 88.

In a preferred embodiment, one sealing member 68 extends from one diaphragm 30' to an adjacent diaphragm 30' to seal the entire gap across one sector 24', as shown in FIG. 4. This allows each sealing member 68 to be oriented and mounted to either the basket structure 48', or 50' or to the upper or lower rotor shell segments 86, or 88 in a manner that ensures that the gap is closed.

Preferably, the sealing members 68 are composed of low alloy steel, or similar material, and are mounted to the basket structure 48' or 50' or to the upper or lower rotor shell segments 86 or 88 by a skip-weld. The sealing members 68 must be removed to provide access for replacing the basketed element. Consequently, the sealing members 68 are composed of inexpensive material and mounted in an inexpensive and easily performed manner to facilitate removal and replacement.

The use of sealing members 68 in place of the full rotor shell 42 reduces shop-welding time. Elimination of the cold end rotor covers 56 and the studding 58 required to mount the covers 56 to the rotor shell 42 reduces manufacturing costs and allows the preheaters to be manufactured with a shorter lead time. As shown above, the use of sealing members 68 provides greater flexibility to address variations in the dimensions of the diaphragms 30' and the hot-end and cold-end basketed element 48' and 50' decreasing flow bypass. Reduction of flow bypass increases the thermal efficiency of the air preheater. In addition, the use of sealing members 68 allows the outboard end of the hot-end and cold-end baskets 48' and 50' to extend beyond that allowed by conventional designs.

We claim:

1. A sealing system for use in a rotary regenerative air preheater including a rotor having a cold-end, a hot-end, upper and lower rotor shell portions, a plurality of circumferentially spaced radially extending diaphragms forming compartments in the rotor, a plurality of heat exchange baskets disposed in the compartments wherein one of the heat exchange baskets in each compartment defines a hot-end outboard basket and one of the heat exchange baskets in each compartment defines a cold-end outboard basket, the hot-end and cold-end outboard baskets each having upper, lower and outboard surfaces, the upper surface of the hot-end outboard basket and the upper shell portion defining a first gap therebetween, the lower surface of the hot-end outboard basket and the upper surface of the cold-end outboard basket defining a second gap therebetween, and the lower surface of the cold-end outboard basket and the lower rotor shell segment defining a third gap therebetween, the sealing system comprising a first sealing member disposed adjacent the outboard surface of the hot-end outboard basket for sealing the first gap, a second sealing member disposed adjacent the outboard surfaces of the hot-end and cold-end baskets for sealing the second gap, and a third sealing member disposed adjacent the outboard surface of the cold-end basket for sealing the third gap, wherein the second sealing member is mounted to the outboard surface of one of the hot-end outboard basket and the cold-end outboard basket.

2. The sealing system of claim 1 wherein each of the sealing members has an arcuate-shape.

3. The sealing system of claim 1 wherein each of the sealing members has a first portion and an orthogonally extending second portion.

4. The sealing system of claim 1 wherein the first sealing member is mounted to one of the upper rotor shell and the outboard surface of the hot-end outboard basket, whereby the first gap is sealed.

5. The sealing system of claim 4 wherein each of the sealing members has first and second portions, wherein the first portion of the first sealing member engages the upper rotor shell segment and the outboard surface of the hot-end outboard basket.

6. The sealing system of claim 4 wherein each of the sealing members has first and second portions, wherein the first portion of the first sealing member engages the upper rotor shell segment and the second portion of the first sealing member engages the upper surface of the hot-end outboard basket.

7. The sealing system of claim 1 wherein each of the second sealing members has first and second portions, wherein the first portion of the second sealing member is mounted to the outboard surface of the hot-end outboard basket and second portion of the second sealing member is mounted to the outboard surface of the cold-end outboard basket.

8. The sealing system of claim 1 wherein the third sealing member is mounted to the outboard surface of the cold-end outboard basket, whereby the third gap is sealed.

9. The sealing system of claim 8 wherein each of the third sealing members has first and second portions, wherein the first portion of the third sealing member engages the lower rotor shell segment and the outboard surface of the cold-end outboard basket.

10. The sealing system of claim 8 wherein each of the third sealing members has first and second portions, wherein the first portion of the third sealing member engages the lower rotor shell segment and the second portion of the third sealing member engages the lower surface of the cold-end outboard basket.

11. A rotor for use in rotary regenerative air preheater, the rotor having cold and hot ends and comprising:

upper and lower rotor shell segments;

a plurality of circumferentially spaced radially extending diaphragms forming compartments in the rotor;

at least a hot-end outboard heat exchange basket and a cold-end outboard heat exchange basket disposed in each of the compartments, the hot-end and cold-end outboard heat exchange baskets each having upper, lower and outboard surfaces, the upper surface of the hot-end outboard basket and the upper shell portion defining a first gap therebetween, the lower surface of the hot-end outboard basket and the upper surface of the cold-end outboard basket defining a second gap therebetween, and the lower surface of the cold-end outboard basket and the lower rotor shell segment defining a third gap therebetween; and first, second and third sealing members wherein the first sealing member is mounted to one of the upper rotor shell segment and the outboard surface of the hot-end outboard heat exchange basket whereby the first gap is sealed, the second sealing member is mounted to the outboard surface of one of the hot-end outboard heat exchange basket and the cold-end outboard heat exchange basket whereby the second gap is sealed, and the third sealing member is mounted to one of the lower rotor shell segment and the outboard surface of the cold-end outboard heat exchange basket whereby the third gap is sealed.

12. The rotor of claim 11 wherein each of the sealing members has an arcuate-shape.

13. The rotor of claim 11 wherein each of the sealing members has first and second portions.

14. The rotor of claim 13 wherein the first portion of the first sealing member engages the upper rotor shell segment and the outboard surface of the hot-end outboard heat exchange basket.

15. The rotor of claim 13 wherein the first portion of the first sealing member engages the upper rotor shell segment and the second portion of the first sealing member engages the upper surface of the hot-end outboard heat exchange basket.

16. The rotor of claim 13 wherein the first portion of the second sealing member engages the outboard surface of the hot-end outboard heat exchange basket and the outboard surface of the cold-end outboard heat exchange basket.

17. The rotor of claim 13 wherein the first portion of the third sealing member engages the lower rotor shell segment and the outboard surface of the cold-end outboard heat exchange basket.

18. The rotor of claim 13 wherein the first portion of the third sealing member engages the lower rotor shell segment and a surface of the second portion engages the lower surface of the cold-end outboard heat exchange basket.

19. A sealing system for use in a rotary regenerative air preheater including a rotor having a cold-end, a hot-end, upper and lower rotor shell portions, a plurality of circumferentially spaced radially extending diaphragms forming compartments in the rotor, a plurality of heat exchange baskets disposed in the compartments wherein one of the heat exchange baskets in each compartment defines a hot-end outboard basket and one of the heat exchange baskets in each compartment defines a cold-end outboard basket, the hot-end and cold-end outboard baskets each having upper, lower and outboard surfaces, the upper surface of the hot-end outboard basket and the upper shell portion defining a first gap therebetween, the lower surface of the hot-end outboard basket and the upper surface of the cold-end outboard basket defining a second gap therebetween, and the lower surface of the cold-end outboard basket and the lower rotor shell segment defining a third gap therebetween, the sealing system comprising a first sealing member sealing the first gap, a second sealing member sealing the second gap, and a third sealing member sealing the third gap, wherein the second sealing member has first and second portions, the first portion of the second sealing member being mounted to the outboard surface of the hot-end outboard basket and the second portion of the second sealing member being mounted to the outboard surface of the cold-end outboard basket.

* * * * *